US007926209B2

(12) United States Patent
Yeung et al.

(10) Patent No.: US 7,926,209 B2
(45) Date of Patent: Apr. 19, 2011

(54) ELECTRIC IRON

(75) Inventors: Wing Yiu Yeung, Hong Kong (HK); Keith Mario Torpy, Sydney (AU)

(73) Assignee: Advanced Materials Enterprises Company Limited, Hong Kong (HK)

( * ) Notice: Subject to any disclaimer, the term of this patent is extended or adjusted under 35 U.S.C. 154(b) by 407 days.

(21) Appl. No.: 12/134,231

(22) Filed: Jun. 6, 2008

(65) Prior Publication Data

US 2008/0235998 A1 Oct. 2, 2008

Related U.S. Application Data

(63) Continuation-in-part of application No. 12/026,724, filed on Feb. 6, 2008.

(60) Provisional application No. 60/900,994, filed on Feb. 13, 2007, provisional application No. 60/990,619, filed on Nov. 28, 2007.

(51) Int. Cl.
*D06F 75/38* (2006.01)
*D06F 75/00* (2006.01)

(52) U.S. Cl. ..... 38/93

(58) Field of Classification Search ..... 219/245, 219/250, 254, 255; 38/93, 77.83, 88, 89, 38/74, 77.7

See application file for complete search history.

(56) References Cited

U.S. PATENT DOCUMENTS

| | | | | |
|---|---|---|---|---|
| 4,057,707 | A * | 11/1977 | Allen | 219/543 |
| 5,448,037 | A | 9/1995 | Takase et al. | |
| 6,018,897 | A * | 2/2000 | Lin | 38/82 |
| 6,465,763 | B1 * | 10/2002 | Ito et al. | 219/444.1 |
| 7,797,863 | B2 * | 9/2010 | Moreno Jordana | 38/93 |
| 2008/0189993 | A1 * | 8/2008 | Cavada | 38/82 |

FOREIGN PATENT DOCUMENTS

| | | |
|---|---|---|
| CN | 87215177 U | 10/1988 |
| GB | 2272226 | * 11/1994 |
| WO | WO 00/18189 | 3/2000 |

* cited by examiner

*Primary Examiner* — Ismael Izaguirre

(57) ABSTRACT

An electric iron includes a soleplate and at least one heating element. The heating element includes multi-layer conductive coating of nano-thickness disposed on the soleplate. The heating element further includes electrodes disposed on the multi-layer conductive coating. The multi-layer conductive coating has a structure and composition which stabilize performance of the heating element at high temperatures. The soleplate can be made of ceramic glass. The electric iron can perform heating and ironing functions using alternating current electrical power, direct current electrical power, solar energy power, or one or more batteries.

28 Claims, 10 Drawing Sheets

ELECTRIC IRON

CROSS-REFERENCE TO RELATED APPLICATIONS

The present patent application is a continuation-in-part (CIP) patent application of U.S. patent application Ser. No. 12/026,724 filed Feb. 6, 2008, which claims benefits from U.S. Provisional Patent Application No. 60/900,994 filed Feb. 13, 2007 and U.S. Provisional Patent Application No. 60/990,619 filed Nov. 28, 2007, the entire contents of which are incorporated herein by reference.

FIELD OF PATENT APPLICATION

The present patent application relates to an electric iron. More particularly, the present application relates to an electric iron having at least a heating element with a multi-layer conductive coating of nano-thickness and electrodes.

BACKGROUND

The soleplate of a conventional electric iron is usually heated by an electric resistance heater which is mounted inside a housing. The resistance heater includes one or more wire-like resistors which can be connected to an electric power source whereby the resistors generate heat to heat up the soleplate. The resistance heater is installed on the soleplate. Such electric iron is rather complicated in construction. The cost of manufacturing and assembly of the electric resistance heater is rather high, especially since it has to be mounted on a support made of an electrically insulating material.

Furthermore, it takes a relatively long period of time to heat an electric resistance heater until it begins to generate heat at the desired rate, and it takes a relatively long period of time to ensure that an electric resistance heater is adequately cooled upon completion of an ironing operation. Thus, large quantities of heat energy are lost during heating and cooling of the soleplate.

A conventional soleplate can be made of a single piece of metal such as aluminum or steel. An advantage of aluminum is that its heat conductivity is quite satisfactory and that it is relatively light in weight. However, the ability of an aluminum soleplate to resist scratching, scoring and similar damage is unsatisfactory. A soleplate which is made of steel is more resistant to wear and scratching. However, it is rather heavy in weight and its thermal conductivity is not satisfactory.

Another kind of soleplate is formed of two pieces made of different materials. There is a core portion which is electrically heatable and is made of aluminum. It carries a thin-walled base plate of steel which comes in actual contact with the clothing to be ironed. This kind of soleplate is complicated in structure and increases the cost of the soleplate and of the entire iron.

Conventional heating elements of electric irons are often of high electrical resistance. Electrical current is hence low under direct current electrical power and incapable of generating sufficient energy uniformly over an area for heating.

Therefore, there is a need to provide an improved electric iron that is simple in construction, less costly to manufacture, light in weight, capable of using direct current electrical power or batteries, and high in heating efficiency.

The above description of the background is provided to aid in understanding the heating element and the electric iron disclosed in the present application, but is not admitted to describe or constitute pertinent prior art to the heating element and the electric iron disclosed in the present application, or consider any document cited herein as material to the patentability of the claims of the present application.

SUMMARY

An electric iron includes a soleplate and at least a heating element. The heating element includes at least one multi-layer conductive coating of nano-thickness disposed on the soleplate. The heating element further includes electrodes disposed on the multi-layer conductive coating. The multi-layer conductive coating has a structure and composition which stabilize performance of the heating element at high temperatures.

The electric iron can perform heating and ironing functions using alternating current electrical power, direct current electrical power, solar energy power, or one or more batteries.

In one embodiment, the electric iron includes a power charger or power converter.

In one embodiment, the electric iron is cordless.

In one embodiment, the electric iron includes a plurality of heating elements electrically connected one another in parallel.

In one embodiment, the electric iron includes a plurality of heating elements electrically connected one another in series.

In one embodiment, the electric iron includes a plurality of heating elements electrically connected one another, and the multi-layer conductive coatings of the heating elements are constructed in a same size.

In one embodiment, the electric iron includes a plurality of heating elements electrically connected one another, and the multi-layer conductive coatings of the heating elements are constructed in different sizes.

In one embodiment, the electric iron includes a plurality of heating elements electrically connected one another, and the multi-layer conductive coatings of the heating elements are constructed in same characteristics.

In one embodiment, the electric iron includes a plurality of heating elements electrically connected one another, and the multi-layer conductive coatings of the heating elements are constructed in different characteristics.

In one embodiment, the multi-layer conductive coating of the heating element has a size of about 30 mm to about 150 mm in length and about 10 mm to about 80 mm in width.

In one embodiment, the electrical resistance of the multi-layer conductive coating of the heating element is about 5 ohms to about 50 ohms.

In one embodiment, the soleplate is made of ceramic glass.

In one embodiment, the electric iron includes a protective layer disposed over the electrodes and the conductive coating, and the electrodes and the conductive coating are sandwiched between the protective layer and the soleplate. The protective layer is made of ceramic glass or other insulating materials.

In one embodiment, a multi-layer insulating coating of nano-thickness is disposed between the multi-layer conductive coating and the soleplate.

The multi-layer conductive coating of the heating element may be produced by spray pyrolysis.

In one embodiment, the spray pyrolysis can be carried out at a temperature of about 650° C. to about 750° C.

In one embodiment, the spray pyrolysis can be carried out at a spray pressure of about 0.4 MPa to about 0.7 MPa.

In one embodiment, the spray pyrolysis can be carried out at a spray head speed of less than 1000 mm per second.

In one embodiment, the spray pyrolysis can be carried out by alternating spray passes in a direction of about 90 degrees to each other.

In one embodiment, the heating element includes a multi-layer insulating coating of nano-thickness disposed between the multi-layer conductive coating and the soleplate. The multi-layer insulating coating may include sol-gel derived silicon dioxide.

BRIEF DESCRIPTION OF THE DRAWINGS

Specific embodiments of the heating element and the electric iron disclosed in the present application will now be described by way of example with reference to the accompanying drawings wherein.

DETAILED DESCRIPTION

It should be understood that the electric iron and the heating element are not limited to the precise embodiments described below and that various changes and modifications thereof may be effected by one skilled in the art without departing from the spirit or scope of the appended claims. For example, elements and/or features of different illustrative embodiments may be combined with each other and/or substituted for each other within the scope of this disclosure and appended claims.

As used herein, the term "a multi-layer coating" or "a multi-layered coating" refers to a coating having more than one layer of a coating material.

As used herein, the term "nano-thickness" refers to a thickness of each coating layer only measurable in nanometer at the nanometer level.

Figure 1:
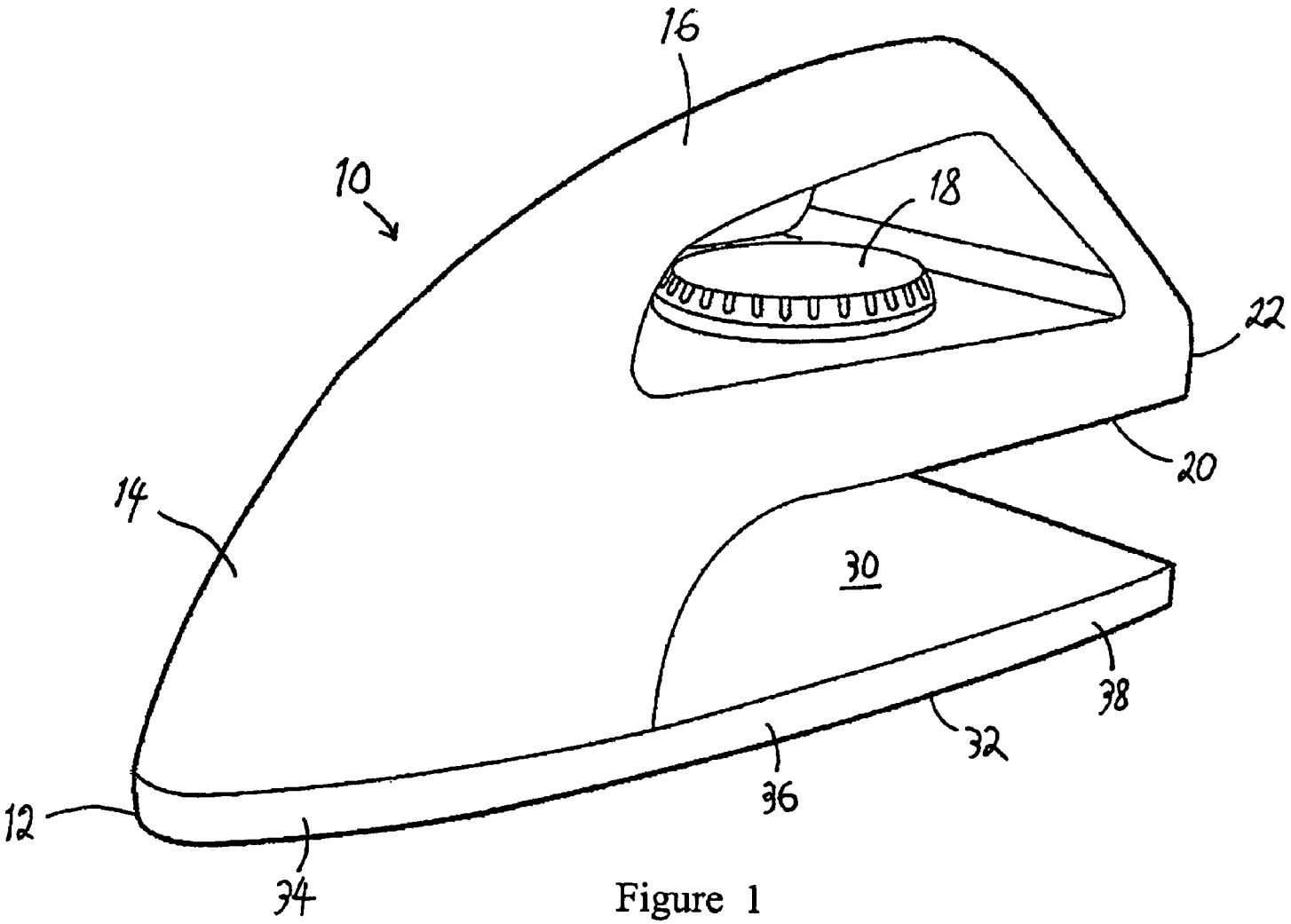
FIG. 1 is a perspective view of an electric iron according to an embodiment of the present application.

FIG. 1 is a perspective view of an electric iron 10 according to an embodiment of the present patent application. The electric iron 10 includes a soleplate 12, a housing 14, a handle 16, and a temperature control knob 18.

According to the illustrated embodiment, the soleplate 12 can be in the form of a plate having a uniform thickness which leads to uniform distribution of heat throughout the soleplate 12. The soleplate 12 may have a thickness of about 4 mm. The soleplate 12 has a top surface 30 and a bottom ironing surface 32. The soleplate 12 and the ironing surface 32 can generally be boat-shaped as in a conventional electric iron. The soleplate 12 has a front tip portion 34, a middle portion 36, and a rear end portion 38.

It is to be understood that the soleplate 12 can be in the form of a plate having a non-uniform thickness. It is also to be understood that the thickness of the soleplate 12 may be greater than 4 mm or less than 4 mm. It is further to be understood that the soleplate 12 and the ironing surface 32 can be other shapes.

According to the illustrated embodiment, the housing 14 is connected to the front tip portion 34 of the soleplate 12, leaving the middle portion 36 and the rear end portion 38 exposed to the surrounding air and at a distance from the housing 14 and the handle 16. This allows the heat generated by the soleplate 12 to be dissipated into the surrounding air rather than towards the housing 14 and the handle 16. This can prevent the electronic components, such as a printed circuit board, inside the housing 14 or the handle 16 from being damaged by heat when the electric iron 10 is in operation. This also facilitates fast air cooling of the soleplate 12 when ironing is finished and the heating element is turned off.

The soleplate 12 can be detachably connected to the housing 14 for easy maintenance and repair of the mechanical and electronic parts inside the housing 14.

Figure 2:
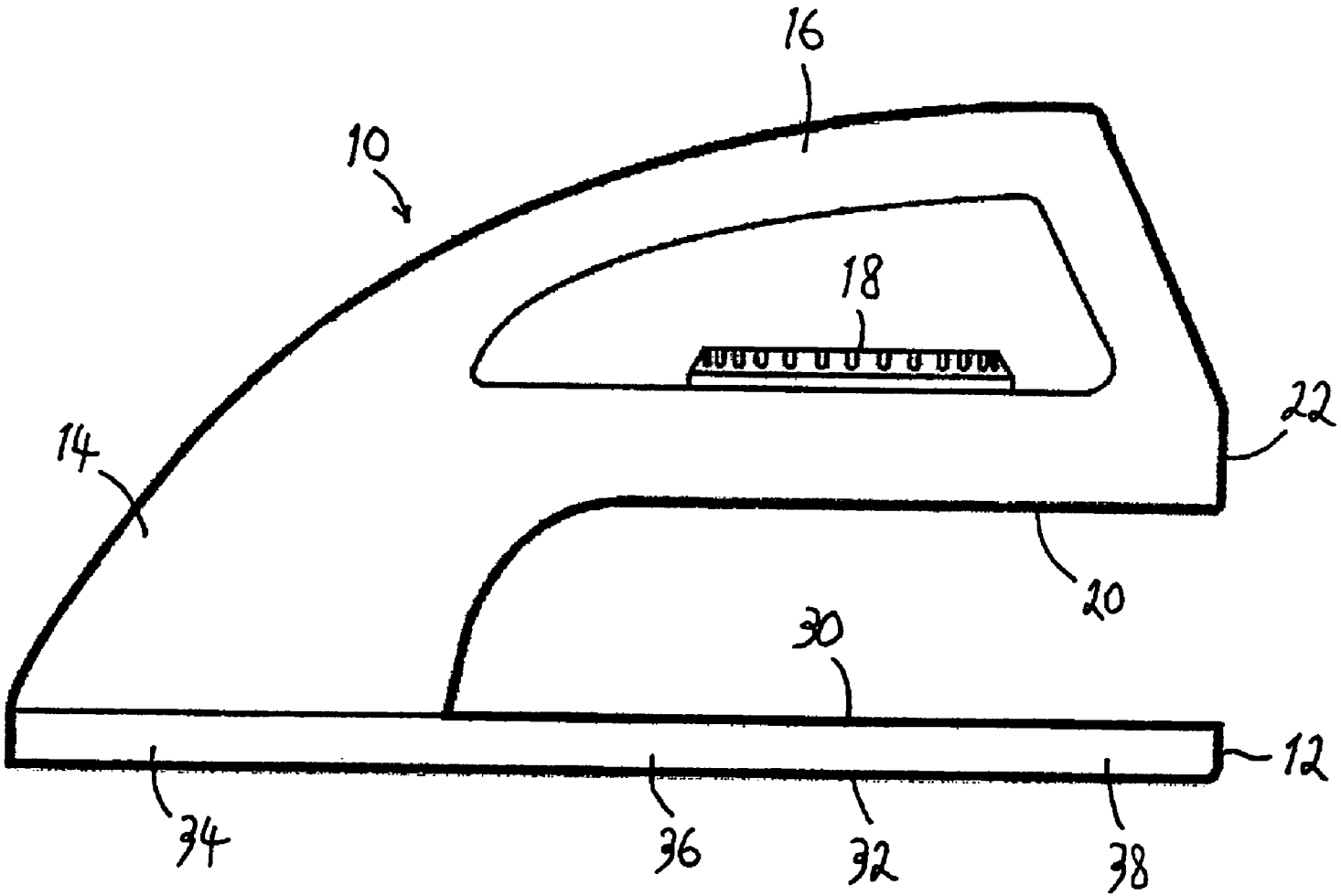
FIG. 2 is a side view of the electric iron.

FIG. 2 is a side view of the electric iron 10. As best illustrated in FIG. 2, the housing 14 is connected to the front tip portion 34 of the soleplate 12, and the lower surface 20 of the handle 16 is substantially parallel to and spaced apart from the middle and rear end portions 36, 38 of the soleplate 12.

Although it has been shown in the illustrated embodiment that the housing 14 is attached to the front tip portion 34 of the soleplate 12, it is understood by one skilled in the art that the housing 14 can be attached to the middle portion 36 and/or the rear end portion 38 of the soleplate 12. For example, the housing 14 can be attached to the rear end portion 38 of the soleplate 12, leaving the front tip portion 34 and the middle portion 36 exposed to air. This handle can also be modified into other forms in different shapes. For example, the lower section 20 of the handle 16 can be removed but with the handle 16 extended above the rear end of the soleplate.

Figure 3:
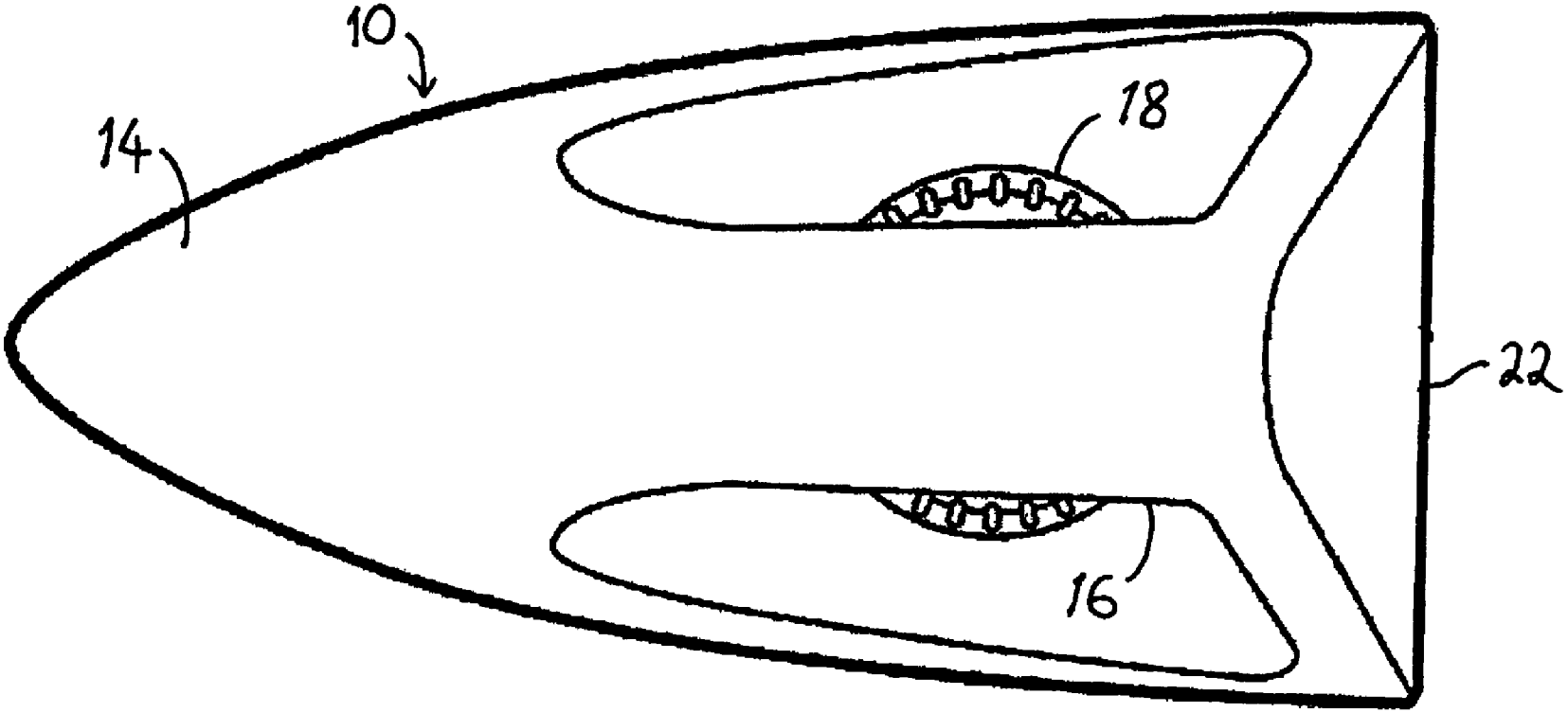
FIG. 3 is a top plan view of the electric iron.

FIG. 3 is a top plan view of the electric iron 10 showing the temperature control knob 18. The temperature control knob 18 is used to vary the temperature of the soleplate 12 by means of an electric circuit provided inside the housing 14 or the handle 16. An indicator such as a light emitting diode (LED) may be provided on the housing 14 or the handle 16 to indicate the ON/OFF condition of the electric iron 10. Additional indicators may be used to indicate other additional conditions of the electric iron 10 if desired.

Figure 4:
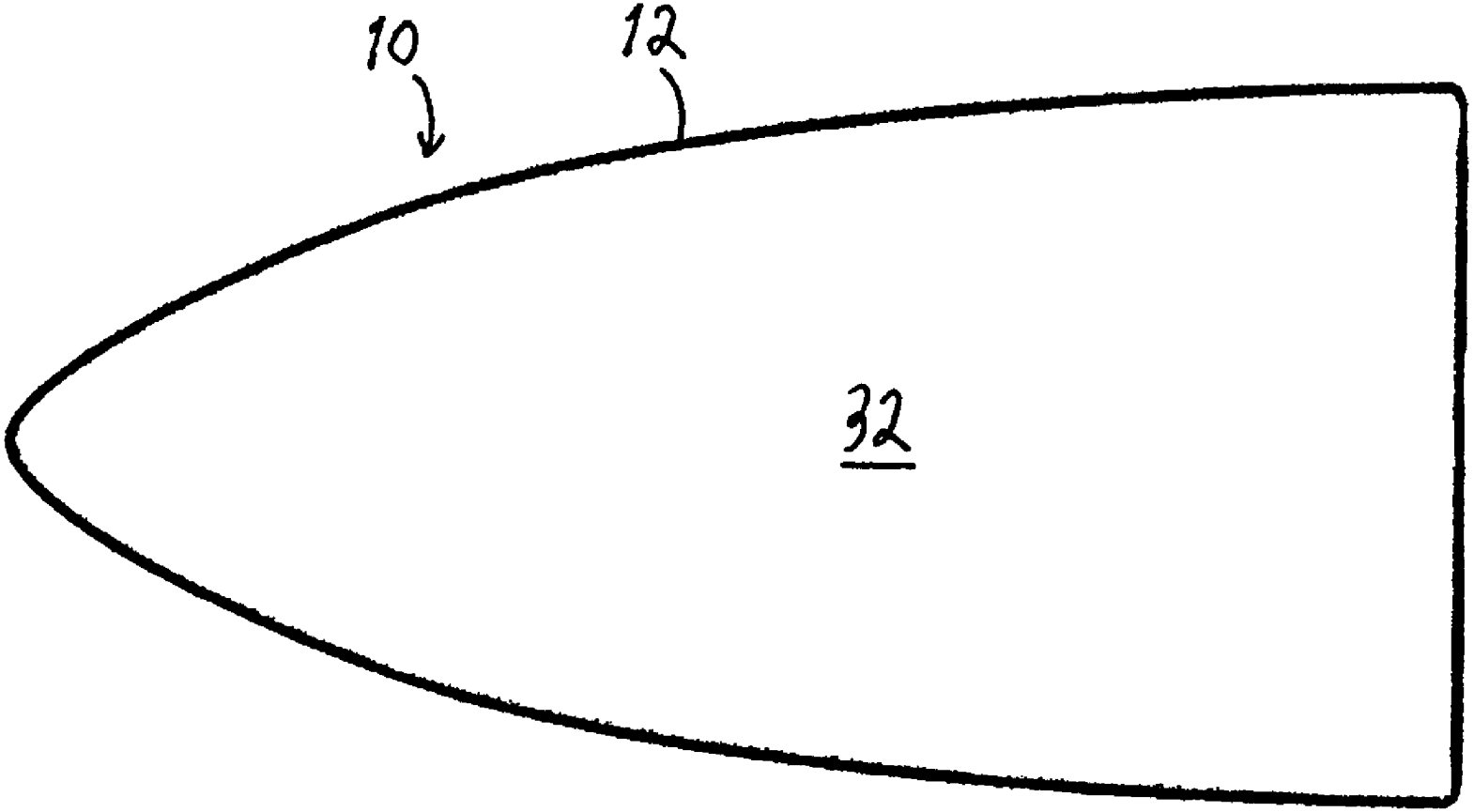
FIG. 4 is a bottom plan view of the electric iron.

FIG. 4 is a bottom plan view of the electric iron 10 showing the conventional boat-shaped soleplate 12. The soleplate 12 may have a length of about 200 mm and a width of about 100 mm.

The soleplate 12 may be made of ceramic glass or any other suitable material. It is understood by one skilled in the art that ceramic glass can survive high temperature and thermal shock, and is often selected over other materials in providing consistent and reliable high temperature heating functions. Furthermore, ceramic glass is highly resistant to wear and scratching of metal buttons and zippers of clothing to be ironed. The ceramic glass can also contain a hard and smooth surface to provide more effective ironing on clothing.

Figure 5:
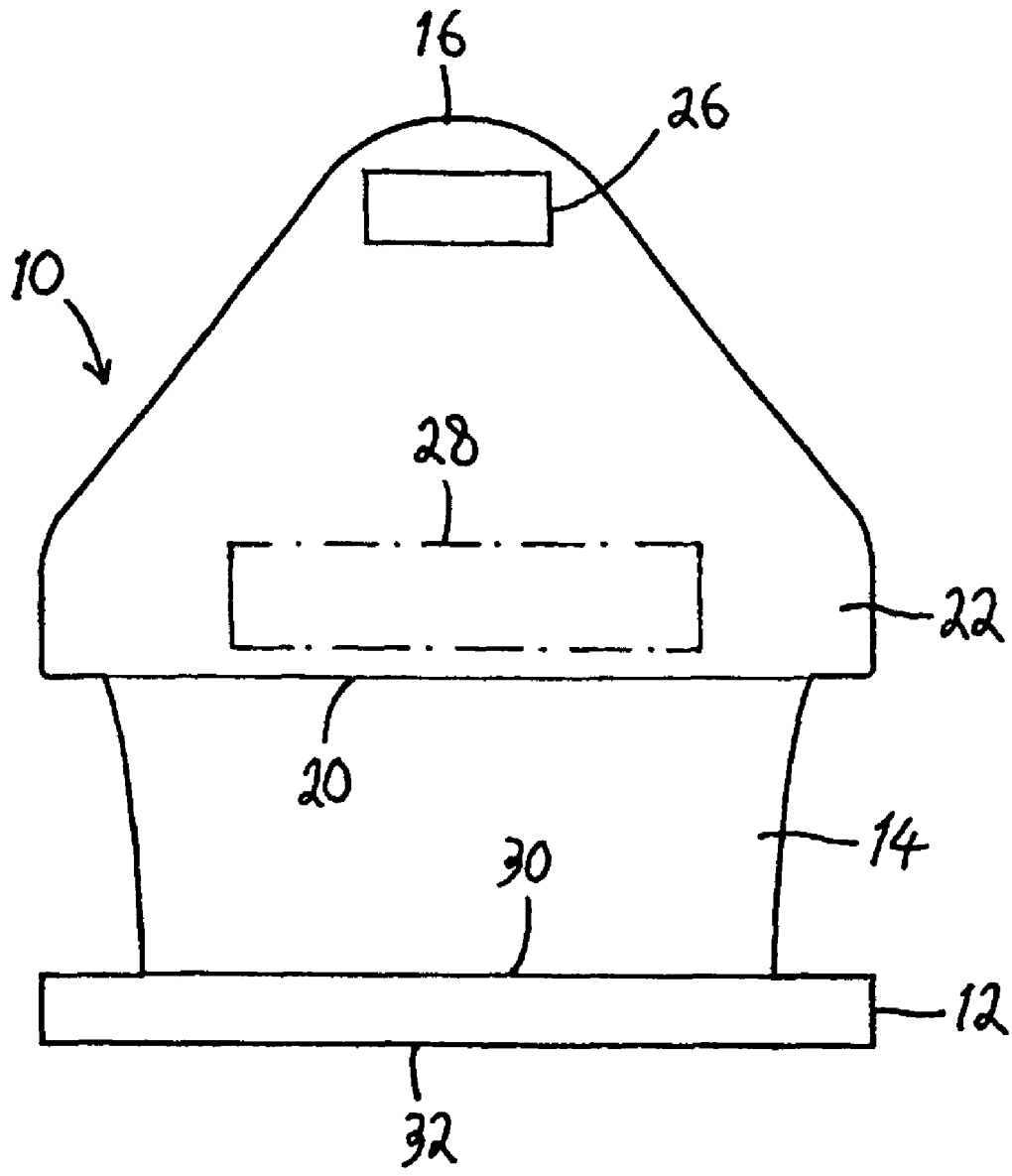
FIG. 5 is a rear end view of the electric iron.

FIG. 5 is a rear end view of the electric iron. As illustrated in FIG. 5, an electrical socket 26 may be provided at a rear end 22 of the handle 16. The plug of a power supply cord can be plugged into the electrical socket 26 for the supply of alternating current electrical power to the electric iron 10. Different forms of power supply and connection can also be used. The alternating current electrical power can be used to heat up the soleplate, or be converted into direct current electrical power through a power charger or converter stand to heat up the soleplate, or be used to charge up rechargeable batteries accommodated in the electric iron or in a charger stand where the electric iron stands or sits on.

A compartment 28 may be formed inside the handle 16 or the housing 14 for the accommodation of a rechargeable or non-chargeable battery or batteries to provide direct current electrical power to the electric iron 10.

The rear end portion 38 of the soleplate 12 and the rear end 22 of the handle 16 can define a heel rest whereby the electric iron 10 can stand with the soleplate 12 in an upright position when the electric iron 10 is temporarily not in use or placed on a power charger or converter. This handle can also be modified into other forms for these purposes and for different requirements.

Figure 6:
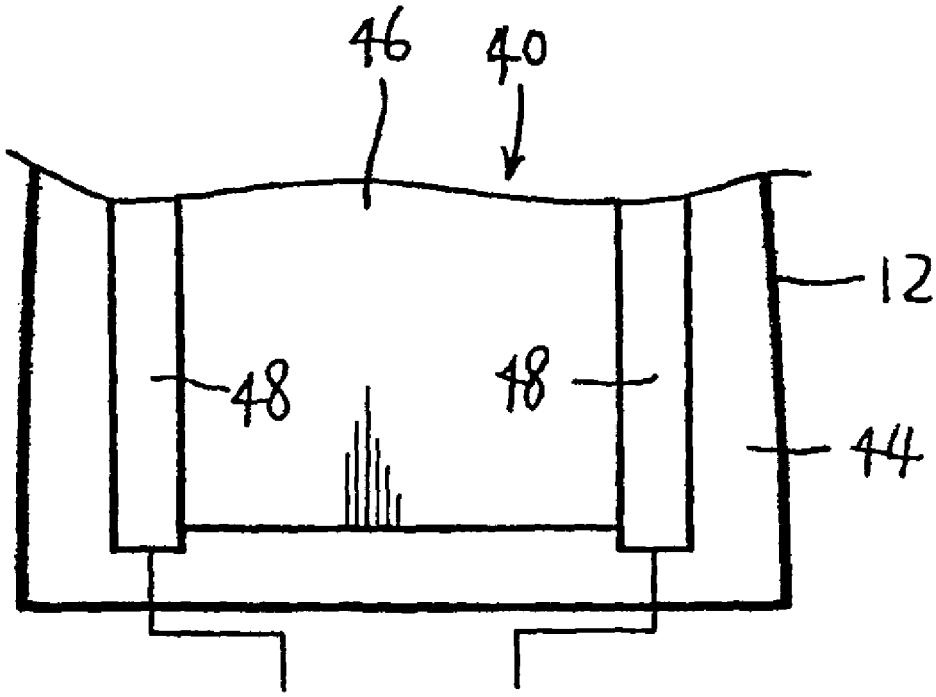
FIG. 6 is a partial top plan view of soleplate of an electric iron with a heating element according to an embodiment of the present application.
Figure 7:
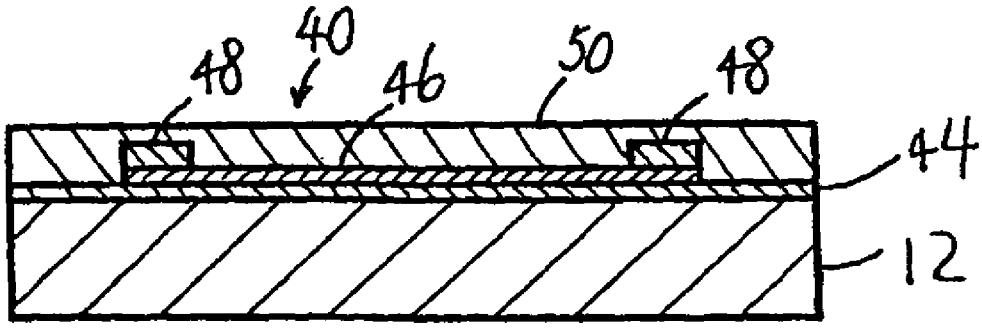
FIG. 7 is a cross sectional view of the heating element of FIG. 6.

FIG. 6 is a partial top plan view of soleplate of an electric iron having a heating element 40 according to an embodiment of the present application. FIG. 7 is a cross sectional view of the heating element 40 of FIG. 6.

According to the illustrated embodiment, the heating element 40 includes a multi-layer insulating coating 44 disposed on the soleplate 12, a multi-layer conductive coating 46 disposed on the multi-layer insulating coating 44, and electrodes 48 disposed on the multi-layer conductive coating 46. In another embodiment, the multi-layer insulating coating 44 is not used, and the multi-layer conductive coating 46 is directly disposed on the soleplate 12.

According to the illustrated embodiment in FIG. 7, a protective layer 50 can be disposed over the insulating coating 44, the conductive coating 46, and the electrodes 48. The protective layer 50 serves as a cover to protect the otherwise exposed insulating coating 44, conductive coating 46, and electrodes 48.

The protective layer 50 may cover the entire area of the soleplate 12 such that the insulating coating 44, the conductive coating 46, and the electrodes 48 are sandwiched between the protective layer 50 and the soleplate 12.

The protective layer 50 may be made of the same material as the soleplate 12. That means the protective layer 50 may be made of ceramic glass or other suitable material. Alternatively, the protective layer 50 may be made of an insulating material.

In the illustrated embodiment, the multi-layer insulating coating 44 is disposed on a surface of the ceramic glass soleplate 12. The multi-layer insulating coating 44 may be made of sol-gel derived silicon dioxide ($SiO_2$), or other suitable material. Each layer of the multi-layer insulating coating 44 has a nano-thickness of about 30 nm to about 50 nm. The multi-layer insulating coating 44 can be applied on the surface of the ceramic glass soleplate 12 with a surfactant to ensure 100% wetting of the $SiO_2$ coating on the ceramic glass soleplate 12 to prevent defect sites, to electrically isolate the conductive coating 46 from the ceramic glass soleplate 12 (which may become conductive at high temperature), and to prevent diffusion of lithium ions and other contaminant elements migrating from the ceramic glass soleplate 12 into the conductive coating 46 during heating process.

Perfluoralkyl surfactant of a concentration between about 0.01 and about 0.001% w/w may be used with sodium dioctyl sulphosuccinate of a concentration between about 0.1 and about 0.01% w/w applied on the ceramic glass soleplate 12 using spraying, or dip coating technique, or other suitable techniques.

$SiO_2$ layers can be deposited on the ceramic glass soleplate 12 using dip coating, or other suitable techniques, and using Tetra Ethoxy Ortho Silicate (TEOS) as the base precursor. Each sol-gel silica layer needs to be hydrolysed, dried and fired at about 500° C. using a staged ramp up temperature cycle essentially to remove physical water, chemically bound water and carbon and organic residues from the matrix, resulting in ultra pure $SiO_2$ layers with minimum defects.

In the illustrated embodiment, the multi-layer conductive coating 46 is disposed on the insulating coating 44. The multi-layer conductive coating 46 may also be directly disposed on the soleplate 12. The multi-layer conductive coating 46 may be an oxide coating using a source metal selected from the group consisting of tin, indium, cadmium, tungsten, titanium and vanadium with organometallic precursors like Monobutyl Tin Tri-chloride doped with equal quantities of donor and acceptor elements such as antimony and zinc at about 3 mol % with or without other rare earth elements. It is understood that the multi-layer conductive coating 46 can be made of other suitable materials.

The multi-layer conductive coating 46 may be deposited over the insulating coating 44 or the soleplate 12 using spray pyrolysis with controlled temperature between about 650° C. to about 750° C. at a spray pressure of about 0.4 to about 0.7 MPa, in formation of a multi-layered nano-thickness coating of about 50 to about 70 nm each layer in thickness to ensure uniform distribution of the rare earth materials within the coating leading to increased stability at high temperatures. Preferably, the controlled spray movement is in alternating spray passes in the direction of about 90° to each other. The speed of spray head is restricted to below 1000 mm per second.

The conductive coating material in the multi-layer conductive coating 46 is used to convert electric power into heat energy. The applied heat generation principle is quite different from that of a conventional electric iron in which heating outputs come from a high electrical resistance of metal coils at low heating efficiency and high power loss. In contrast, by adjusting the composition and thickness of the coatings, electrical resistance of the coating can be controlled and conductivity can be increased to generate high heating efficiency with minimal energy loss.

In the illustrated embodiment, two electrodes 48 are formed on the conductive coating 46 along two opposite sides of the conductive coating 46, respectively. The two electrodes 48 may be made of glass ceramic frit based ink, with a source metal selected from the group consisting of platinum, gold, silver, palladium and copper (90-95%), and glass frit (5-10%) made of PbO, $SiO_2$ $CeO_2$ and $Li_2O$ added with an organic vehicle of ethyl cellulose/ethanol. The ink may be screen printed over the conductive coating area with optimum matching between the electrodes 48, the coating 44, 46 and the ceramic glass soleplate 12 in providing consistent conductivity across the coating area. The ink may be screen printed and baked at about 700° C. for about 5 minutes to form the electrodes 48 on the conductive coating 46. This can prevent potential delamination of the electrodes 48 from the coating 44, 46 and the soleplate 12. No prolonged high temperature annealing is required to settle the coatings and electrodes.

For practical commercial and industrial uses in performing high temperature heating functions up to about 300° C. to about 350° C., the insulating coating 44 may not be required to be disposed on the surface of the ceramic glass soleplate 12. Instead, a temperature monitor and control system can be integrated with the conductive coating 46 for optimum temperature and energy saving control.

With the coating composition, the heating element 40 of the electric iron 10 can be manufactured by an inexpensive deposition method in open air environment via spray pyrolysis. In addition, application of controlled multi-spray passes in forming of the multi-layer conductive coating can minimize the application of cerium and lanthanum to an amount below the required 2.5 mol %, and maintain the stability of the conductive coating in performing heating functions. Spray head movement conditions can be established and the speed is restricted to below 1000 mm per second.

It is determined that spray parameters can affect the characteristics of the heating element, and optimum conditions can be established. An example on variation of effective resistances and power ratings (at 220V) of the heating element 40, with a coated area of 150 mm×150 mm, is provided in Tables 1.

Table 1 shows variation of the effective resistances and power ratings of the heating element produced by 2, 6, 10 and 12 spray passes, at a spray head movement speed of about 750 $mms^{-1}$ and at a spray pressure of about 0.5 MPa.

TABLE 1

| Spray Passes | 2 | 6 | 10 | 12 |
|---|---|---|---|---|
| Electrical Resistance (ohm) | 300 | 72 | 38 | 29 |
| Power Rating at 220 V (W) | 161 | 672 | 1273 | 1668 |

The multi-layered nano-thickness coating system disclosed in the present application has the characteristics that the coating material can be deposited by a low-cost spraying process in an open-air environment. This multi-layered nano-thickness coating system renders a heating element of an electric iron to maintain a stable structure and high conductivity, and hence results in consistent electrical resistance and heating performance at high temperature even for a prolonged period.

To achieve the above-mentioned result, an optimum atomization of the spraying material solution and deposition on the soleplate surface are required by a specific selection of the composition and properties of the coating material of the base and doped elements, the process conditions of the spray pyrolysis covering the soleplate surface, including temperature, movement of the spraying head, nozzle design, and spray pressure. The multi-layer coatings of nano-thickness with high conductivity can enhance the coating stability and minimize the risk of formation of cracks.

With the coating composition and processing described in this application, it is capable for both low and high temperature/power output heating for electric irons that require various heating functions.

The coating system of the present application is capable of integration with alternating current electrical power supply, direct current electrical power supply and/or solar energy system for heat generating functions. Conventional heating elements of electric irons are often of high electrical resistance, electrical current is hence low under direct current electrical power and incapable of generating sufficient energy uniformly over an area for heating. Improvement of conductivity and reduction of electrical resistance of the heating films, through controlled spray process, to 10 ohms or below can be achieved. It is capable of generating sufficient energy over an area to perform practical heating and ironing functions using direct current electrical power supply and/or be integrated with solar energy power supply. Using a 24V direct current electrical power supply, the heating element described in this application is able to reach a temperature of 150° C. in less than 2 minutes. With 12V direct current electrical power supply, it is capable of reaching a temperature of 150° C. in less than 8 minutes. The direct current electrical power supply or solar energy power supply can be provided in form of rechargeable or non-rechargeable batteries, or through a power charger or converter inside the electric iron, or through a power charger or converter stand where the electric iron stands or sits on. In these cases, the electric iron can be with a power supply cord or can be cordless.

A plurality of heating elements may be provided on the soleplate of the electric iron. These heating elements may be electrically connected in parallel or in series.

The conductive coatings of the heating elements may be constructed in same characteristics (e.g., structure, composition, thickness, etc.) but in different sizes, such that different densities of power output (Watt/$cm^2$) and different ironing temperatures can be achieved across the soleplate. The conductive coatings of the heating elements may also be constructed in same characteristics and in same size, such that same density of power output and same ironing temperature can be achieved across the soleplate. Further, the conductive coatings of the heating elements may be constructed in different characteristics and in different sizes, but same density of power output and same ironing temperature can be achieved across the soleplate. For domestic electric iron products, to reach effective ironing temperature up to 200° C., the heating elements can be constructed in sizes of about 10 mm about 80 mm in width, about 30 mm about 150 mm in length with electrical resistances ranging about 5 ohms about 50 ohms.

Figure 8:
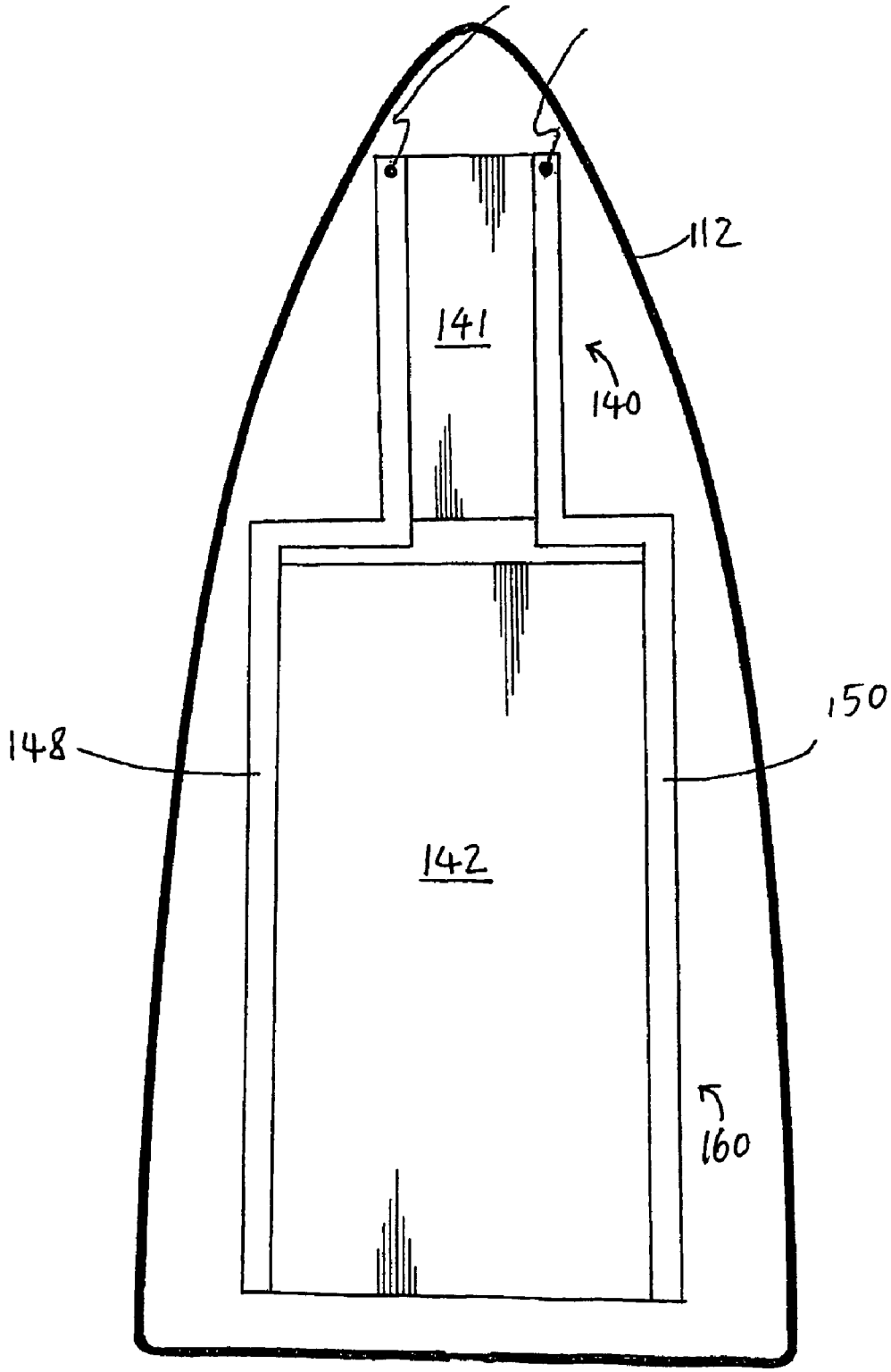
FIG. 8 is a top plan view of a soleplate of the electric iron with two heating elements electrically connected in parallel according to an embodiment of present application.

FIG. 8 is a top plan view of a soleplate 112 of an electric iron with a first heating element 140 and a second heating element 160 electrically connected in parallel by two electrodes 148, 150. The first heating element 140 includes a multi-layer conductive coating 141 disposed on the soleplate 112. The first heating element 140 also includes two electrodes 148, 150 disposed on the multi-layer conductive coating 141. The second heating element 160 includes a multi-layer conductive coating 142 disposed on the soleplate 112. The second heating element 160 also includes two electrodes 148, 150 disposed on the multi-layer conductive coating 142. In this embodiment, the first heating element 140 has a coating area which is smaller than that of the second heating element 160. If the characteristics (e.g., structure, composition, thickness, etc.) of the conductive coatings of the two heating elements 140, 160 are same, higher density of power output (Watt/$cm^2$) and higher ironing temperature can be achieved at the first heating element 140. As a result, the tip portion of the soleplate has a high ironing temperature, and the body portion of the soleplate has a lower ironing temperature. If the conductive coatings of the two heating elements 140, 160 are adjusted to reach a same density of power output, same ironing temperature can be achieved at the two heating elements. As a result, a uniform temperature can be generated across the soleplate 112.

Figure 9:
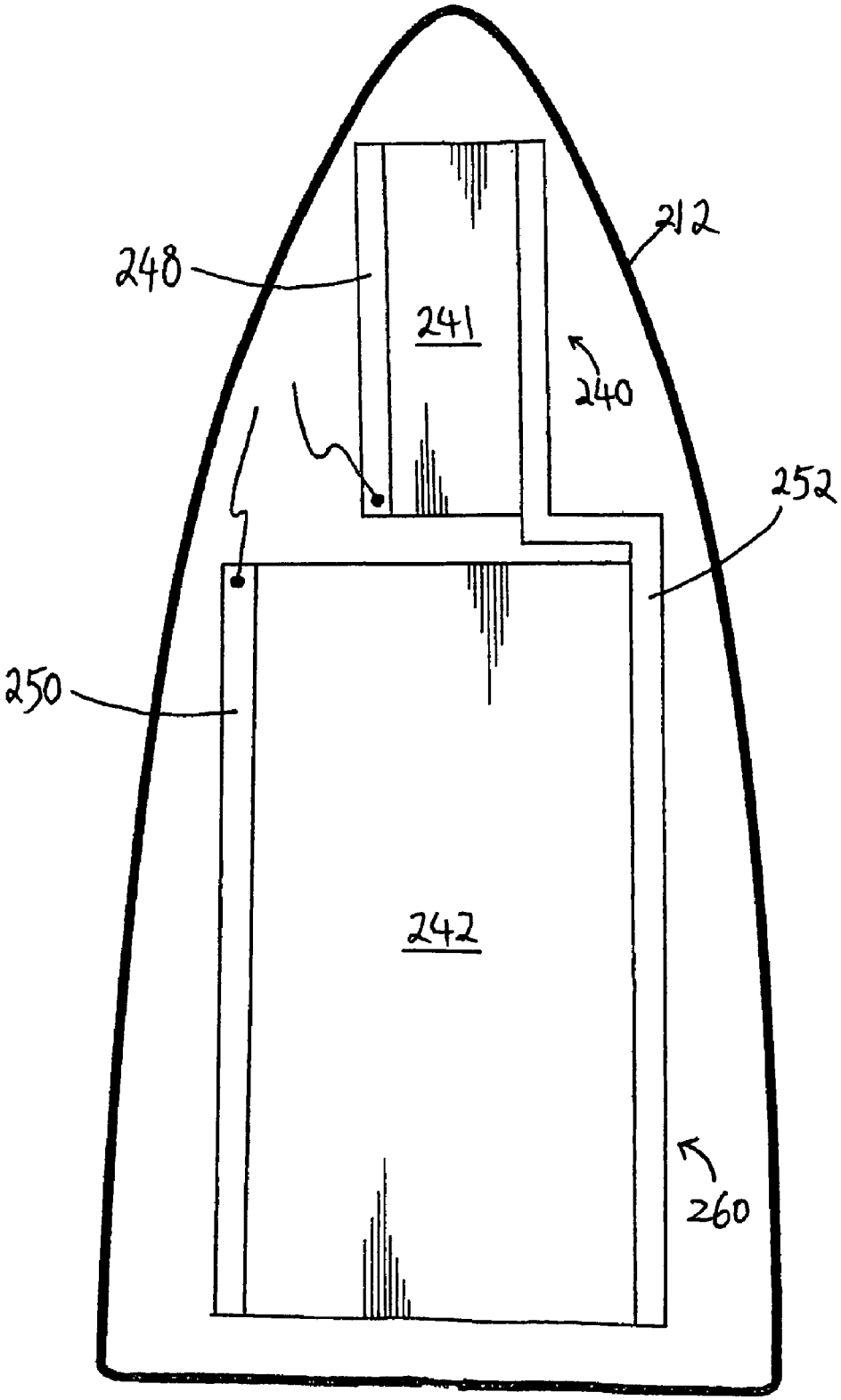
FIG. 9 is a top plan view of a soleplate of the electric iron with two heating elements electrically connected in series according to another embodiment of present application.

FIG. 9 is a top plan view of a soleplate 212 of an electric iron with a first heating element 240 and a second heating element 260 electrically connected in series by an electrode 252. The first heating element 240 includes a multi-layer conductive coating 241 disposed on the soleplate 212. The first heating element 240 also includes two electrodes 248, 252 disposed on the multi-layer conductive coating 241. The second heating element 260 includes a multi-layer conductive coating 242 disposed on the soleplate 212. The second heating element 260 also includes two electrodes 250, 252 disposed on the multi-layer conductive coating 242. In this embodiment, the first heating element 240 has a coating area which is smaller than that of the second heating element 260. If the characteristics (e.g., structure, composition, thickness, etc.) of the conductive coatings of the two heating elements 140, 160 are the same, higher density of power output (Watt/$cm^2$) and higher ironing temperature can be achieved at the first heating element 240. As a result, the tip portion of the soleplate has a higher ironing temperature, and the body portion of the soleplate has a lower ironing temperature. If the conductive coatings of the two heating elements 240, 260 are adjusted to reach a same density of power output, same ironing temperature can be achieved at the two heating elements. As a result, a uniform temperature can be generated across the soleplate 212.

Figure 10:
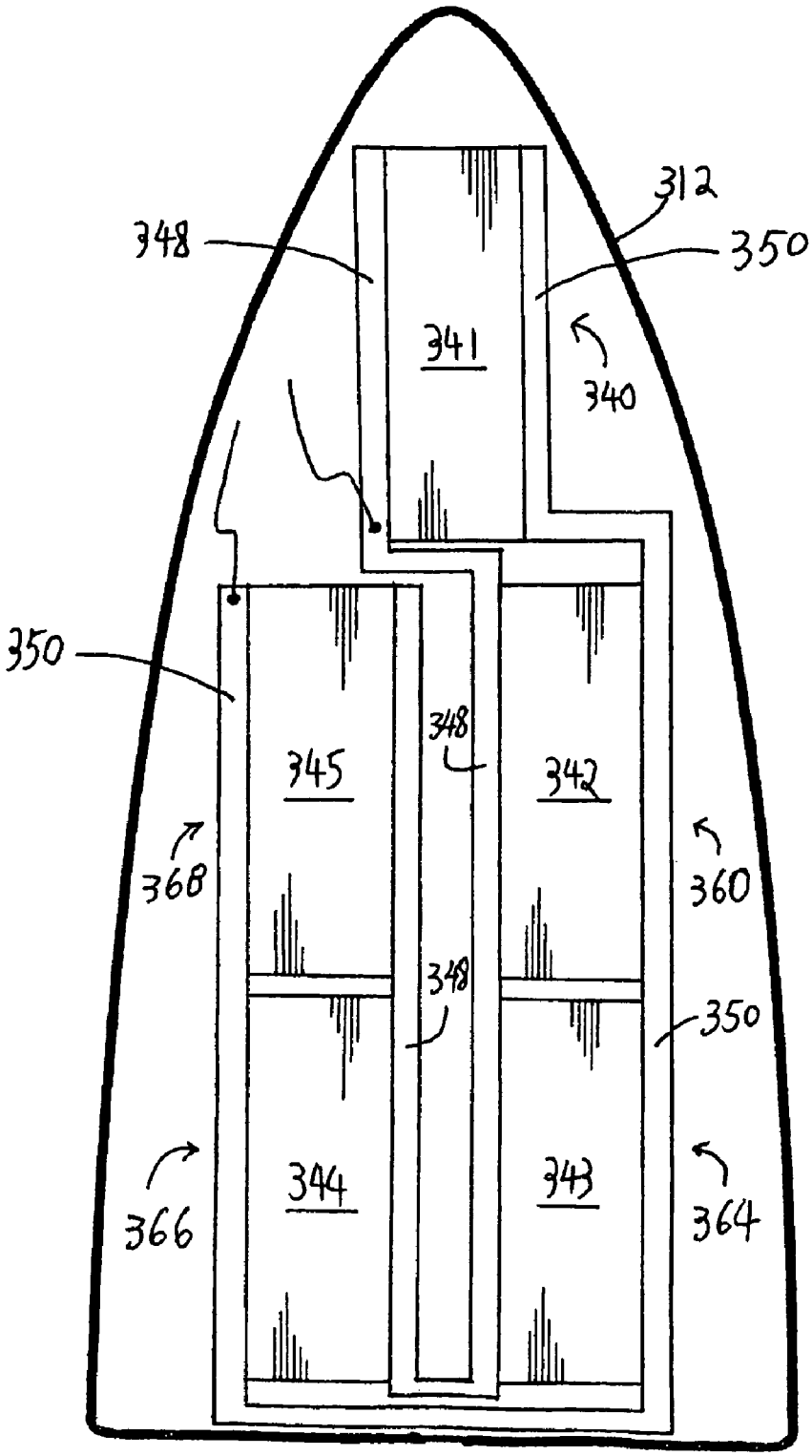
FIG. 10 is a top plan view of a soleplate of the electric iron with five heating elements electrically connected in parallel according to a further embodiment of present application.

FIG. 10 is a top plan view of a soleplate 312 of an electric iron with five heating elements 340, 360, 364, 366, 368 electrically connected in parallel by two electrodes 348, 350. The first heating element 340 includes a multi-layer conductive coating 341 disposed on the soleplate 312. The first heating element 340 also includes two electrodes 348, 350 disposed on the multi-layer conductive coating 341. The second heating element 360 includes a multi-layer conductive coating 342 disposed on the soleplate 312. The second heating element 360 also includes two electrodes 348, 350 disposed on the multi-layer conductive coating 342. The third heating element 364 includes a multi-layer conductive coating 343 disposed on the soleplate 312. The third heating element 364 also includes two electrodes 348, 350 disposed on the multi-layer conductive coating 343. The fourth heating element 366 includes a multi-layer conductive coating 344 disposed on the soleplate 312. The fourth heating element 366 also includes two electrodes 348, 350 disposed on the multi-layer conductive coating 344. The fifth heating element 368 includes a multi-layer conductive coating 345 disposed on the soleplate 312. The fifth heating element 368 also includes two electrodes 348, 350 disposed on the multi-layer conductive coating 345. In this embodiment, the conductive coatings of the five heating elements have the same size. If the characteristics (e.g., structure, composition, thickness, etc.) of the conductive coatings of the five heating elements are the same, same density of power output and same ironing temperature can be achieved at the five heating elements. As a result, a uniform temperature can be generated across the soleplate 312.

Figure 11:
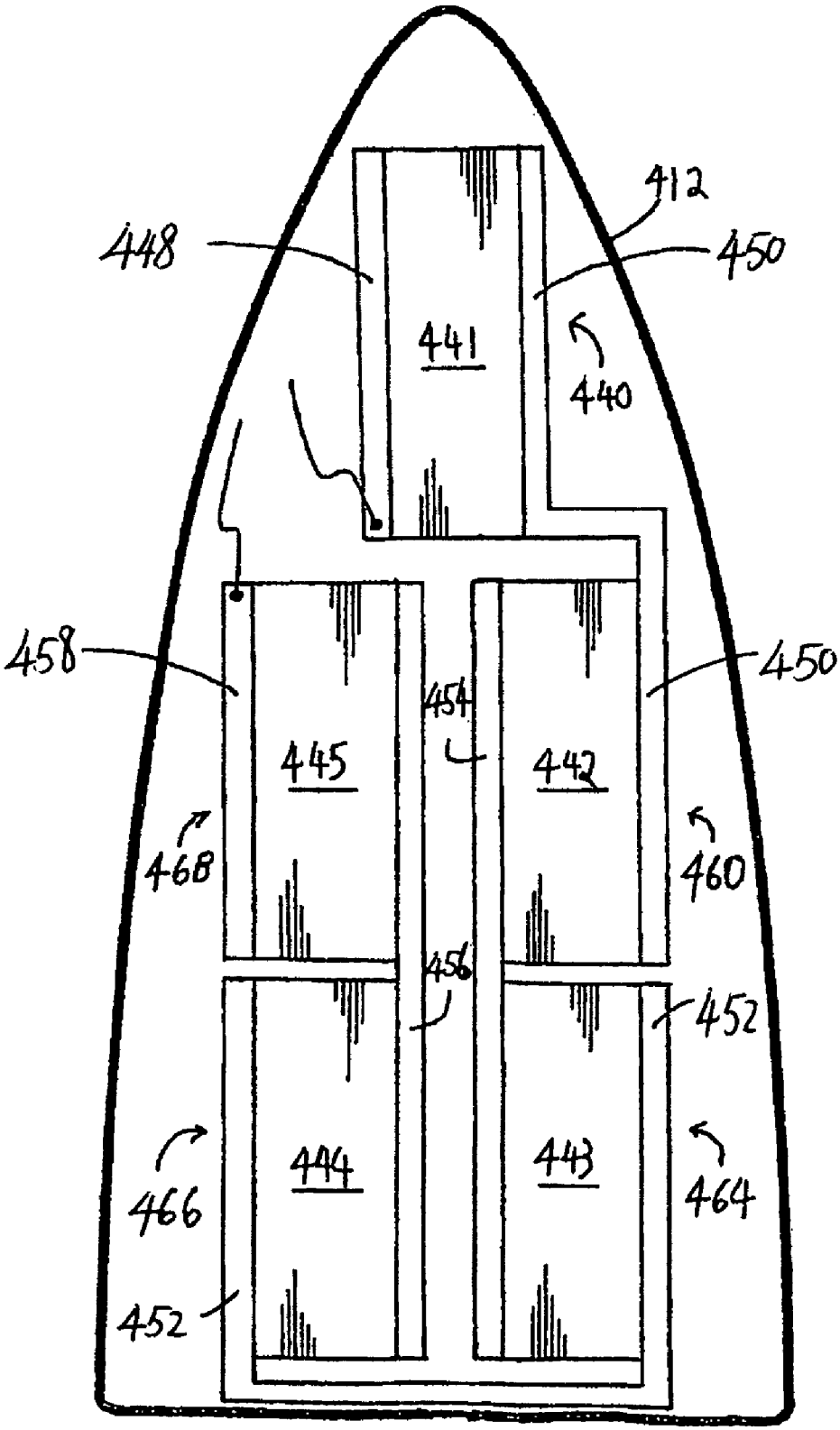
FIG. 11 is a top plan view of a soleplate of the electric iron with five heating elements electrically connected in series according to a further embodiment of present application.

FIG. 11 is a top plan view of a soleplate 412 of an electric iron with five heating elements 440, 460, 464, 466, 468 electrically connected in series. The first heating element 440 includes a multi-layer conductive coating 441 disposed on the soleplate 412. The first heating element 440 also includes two electrodes 448, 450 disposed on the multi-layer conductive coating 441. The second heating element 460 includes a multi-layer conductive coating 442 disposed on the soleplate 412. The second heating element 460 also includes two electrodes 450, 454 disposed on the multi-layer conductive coating 442. The third heating element 464 includes a multi-layer conductive coating 443 disposed on the soleplate 412. The third heating element 464 also includes two electrodes 452, 454 disposed on the multi-layer conductive coating 443. The fourth heating element 466 includes a multi-layer conductive coating 444 disposed on the soleplate 412. The fourth heating element 466 also includes two electrodes 452, 456 disposed on the multi-layer conductive coating 444. The fifth heating element 468 includes a multi-layer conductive coating 445 disposed on the soleplate 412. The fifth heating element 468 also includes two electrodes 456, 458 disposed on the multi-layer conductive coating 445. In this embodiment, the conductive coatings of the five heating elements have the same size. If the characteristics (e.g., structure, composition, thickness, etc.) of the conductive coatings of the five heating elements are the same, same density of power output and same ironing temperature can be achieved at the five heating elements. As a result, a uniform temperature can be generated across the soleplate 412.

While the electric iron and the heating element disclosed in the present application have been shown and described with particular references to a number of preferred embodiments thereof, it should be noted that various other changes or modifications may be made without departing from the scope of the appended claims.

What is claimed is:

1. An electric iron comprising:

a soleplate; and at least one heating element comprising:

a multi-layer conductive coating of nano-thickness disposed on the soleplate; and electrodes disposed on the multi-layer conductive coating, wherein the multi-layer conductive coating comprises an oxide coating including a source metal selected from the group consisting of tin, indium, cadmium, tungsten, titanium and vanadium.

2. The electric iron as claimed in claim 1, comprising a plurality of heating elements electrically connected one another.

3. The electric iron as claimed in claim 2, wherein the plurality of heating elements are electrically connected in parallel.

4. The electric iron as claimed in claim 2, wherein the plurality of heating elements are electrically connected in series.

5. The electric iron as claimed in claim 2, wherein the multi-layer conductive coatings of the heating elements are constructed in a same size.

6. The electric iron as claimed in claim 2, wherein the multi-layer conductive coatings of the heating elements are constructed in different sizes.

7. The electric iron as claimed in claim 2, wherein the multi-layer conductive coatings of the heating elements are constructed in same characteristics.

8. The electric iron as claimed in claim 2, wherein the multi-layer conductive coatings of the heating elements are constructed in different characteristics.

9. The electric iron as claimed in claim 1, wherein the multi-layer conductive coating of the heating element comprises a size of about 30 mm to about 150 mm in length and about 10 mm to about 80 mm in width.

10. The electric iron as claimed in claim 1, wherein the electrical resistance of the multi-layer conductive coating of the heating element is about 5 ohms to about 50 ohms.

11. The electric iron as claimed in claim 1, wherein the soleplate comprises ceramic glass.

12. The electric iron as claimed in claim 1, further comprising a protective layer disposed over the electrodes and the multi-layer conductive coating, wherein the electrodes and the multi-layer conductive coating are sandwiched between the protective layer and the soleplate.

13. The electric iron as claimed in claim 12, wherein the protective layer comprises a ceramic glass or other insulating materials.

14. The electric iron as claimed in claim 1, wherein the electric iron is powered by direct current electrical power or solar energy power.

15. The electric iron as claimed in claim 14, wherein the power is provided by one or more rechargeable or non-rechargeable batteries.

16. The electric iron as claimed in claim 14, further comprising a power charger or power converter.

17. The electric iron as claimed in claim 14, wherein the electric iron is cordless.

18. The electric iron as claimed in claim 1, wherein the electrodes comprises glass ceramic frit based ink including a source metal selected from the group consisting of platinum, gold, silver, palladium and copper.

19. An electric iron comprising:

a soleplate; and at least one heating element comprising:

a multi-layer conductive coating of nano-thickness disposed on the soleplate; and electrodes disposed on the multi-layer conductive coating, wherein the multi-layer conductive coating is produced by spray pyrolysis.

20. The electric iron as claimed in claim 19, wherein the spray pyrolysis is carried out at a temperature of about 650° C. to about 750° C.

21. The electric iron as claimed in claim 19, wherein the spray pyrolysis is carried out at a spray pressure of about 0.4 MPa to about 0.7 MPa.

22. The electric iron as claimed in claim 19, wherein the spray pyrolysis is carried out at a spray head speed of less than 1000 mm per second.

23. The electric iron as claimed in claim 19, wherein the spray pyrolysis is carried out by alternating spray passes in a direction of about 90 degrees to each other.

24. The electric iron as claimed in claim 1, wherein the heating element further comprises a multi-layer insulating coating of nano-thickness disposed between the multi-layer conductive coating and the soleplate.

25. The electric iron as claimed in claim 24, wherein the multi-layer insulating coating comprises sol-gel derived silicon dioxide.

26. An electric iron comprising:

a soleplate; and a plurality of heating elements electrically connected one another, each of the heating elements comprising:

a multi-layer conductive coating of nano-thickness disposed on the soleplate; and electrodes disposed on the multi-layer conductive coating, wherein the multi-layer conductive coating comprises an oxide coating including a source metal selected from the group consisting of tin, indium, cadmium, tungsten, titanium and vanadium, wherein the multi-layer conductive coating is produced by spray pyrolysis; and a protective layer disposed over the electrodes and the multi-layer conductive coating, wherein the electrodes and the multi-layer conductive coating are sandwiched between the protective layer and the soleplate.

27. The electric iron as claimed in claim 26, wherein the plurality of heating elements are electrically connected in parallel.

28. The electric iron as claimed in claim 26, wherein the plurality of heating elements are electrically connected in series.

* * * * *